US006758127B2

(12) United States Patent
Schult

(10) Patent No.: US 6,758,127 B2
(45) Date of Patent: Jul. 6, 2004

(54) PRESSURIZED MEDIUM ACTIVATED WORKING CYLINDER

(75) Inventor: Karl Schult, Alpen (DE)

(73) Assignee: IMI Norgren GmbH, Alpen (DE)

( * ) Notice: Subject to any disclaimer, the term of this patent is extended or adjusted under 35 U.S.C. 154(b) by 0 days.

(21) Appl. No.: 10/027,132

(22) Filed: Dec. 20, 2001

(65) Prior Publication Data

US 2002/0088343 A1 Jul. 11, 2002

(30) Foreign Application Priority Data

Dec. 20, 2000 (DE) ..... 200 21 520 U

(51) Int. Cl.[7] ..... F15B 15/22
(52) U.S. Cl. ..... 91/394; 91/408; 92/165 PR
(58) Field of Search ..... 91/394, 408, 409; 92/165 PR, 177

(56) References Cited

U.S. PATENT DOCUMENTS 2,974,646 A * 3/1961 Miller et al. ..... 91/394
3,027,877 A * 4/1962 Lansky ..... 91/394
3,136,225 A 6/1964 Radar
3,677,141 A * 7/1972 Lagerqvist et al. ..... 91/394
4,088,061 A * 5/1978 Stoll et al. ..... 91/408
6,152,015 A * 11/2000 Migliori ..... 92/177

FOREIGN PATENT DOCUMENTS

EP 0 735 280 A2 10/1996
EP 1 041 293 A2 10/2000

* cited by examiner

*Primary Examiner*—F. Daniel Lopez
(74) *Attorney, Agent, or Firm*—Leydig, Voit & Mayer, Ltd.

(57) ABSTRACT

A pressurized medium activated working cylinder with a piston that can move longitudinally in a cylinder chamber between two end positions has a device for damping the movement of the piston when it approaches each end position. This device comprises, e.g., a damping pin arranged at the cylinder cover, which is inserted into a corresponding receptacle opening in the piston when the piston approaches the end position. The damping pin and the receptacle opening are arranged eccentric to a side of the piston rod, wherein the receptacle opening opens into a part projecting into the cylinder chamber.

15 Claims, 3 Drawing Sheets

PRESSURIZED MEDIUM ACTIVATED WORKING CYLINDER

FIELD OF THE INVENTION

The present invention relates generally to pressure cylinders (i.e. working cylinders) having dampening means for cushioning movement of a pressure operated piston at its opposite ends of travel. More particularly, the invention pertains to a pressurized medium activated working cylinder with a piston supported so that it can move longitudinally in a cylinder chamber between two end positions, with two end parts that close the cylinder chamber at the ends and that have devices for feeding and discharging pressurized medium, with a piston rod that is connected to the piston and that penetrates through at least one of the end parts in a sealed configuration, and with a device for damping the movement of the piston when it approaches each end position, wherein this device has a damping pin and a receptacle opening that matches this pin on the side facing each end part, and this opening is connected to the corresponding device for feeding and discharging pressurized medium and the damping pin is inserted into this opening when the piston approaches the end position.

BACKGROUND OF THE INVENTION

A known working cylinder with dampening means is shown in EP 0 735 280, which includes a damping sleeve that is coaxial to the piston rod on each of the two opposite end faces of the piston. Each damping sleeve matches a coaxial receptacle opening in the adjacent end part. This opening is connected to a type of pocket opening that is completely integrated in the end part and that is connected to a pressurized medium feeding and discharging channel in the end part. The braking of the piston at the end of the stroke, i.e., when the piston approaches the end position, happens in such a way that the passage cross section for the pressurized medium flowing out of the decreasing section of the cylinder chamber is substantially reduced by the insertion of the damping sleeve into the receptacle opening. Because the damping sleeves must have an exact axial length, and the extending piston must be held completely in the matching end part for the corresponding end positions, so that the piston essentially contacts the end part, the installation size of the working cylinder must be lengthened for the damping sleeves. This applies even more so for the known working cylinder, since in each end part there is an additional check valve with a valve body that extends into the cylinder chamber, and thus for the out-stroke of the piston from its end position, it enables rapid filling of pressurized medium into the now increasing cylinder chamber section. For certain applications which require a relatively short working cylinder the type of known working cylinder cannot be used.

Other solutions for working cylinders with end position damping of the piston are described in EP 1 041 293 A2 and U.S. Pat. No. 3,136,225. A valve element supported with a helical spring is provided for the piston of these working cylinders, such that the outward flow of the pressurized medium from the decreasing cylinder chamber section is throttled before reaching the end of the stroke. However, due to reasons of stability, these working cylinder constructions require relatively thick piston rods, aside from the fact that they are relatively complex and expensive.

OBJECTS AND SUMMARY OF THE INVENTION

It is an object of the present invention to provide a pressurized fluid operated cylinder, i.e. working cylinder, with end positioning dampening of the piston which has a short length construction that is simple in design and which lends itself to reliable operation.

A working cylinder according to the invention has a damping device which includes a damping pin and a receptacle opening that matches the pin arranged eccentric to the side near the piston rod, wherein the receptacle opening opens into a part projecting from each end part or from the piston into the cylinder chamber. This part matches a corresponding recess on the opposing side of the piston. In order to ensure that the damping pins find the corresponding end position during the in-stroke of the piston for reliably entering into the receptacle opening, the piston has an associated guide device.

Due to the fact that the damping pin with its matching receptacle opening is located to the side of the piston rod, the arrangement of the damping pin and the recess surrounding the pin is independent of the attachment of the piston rod to the piston. The receptacle opening into the cylinder chamber for the damping pin permits a short length construction of the working cylinder, without adversely affecting end position damping of the piston.

In order to achieve rapid filling of the increasing section of the cylinder chamber and thus quick piston movement for the out-stroke of the piston from its end position, a check valve that is connected to the devices for feeding and discharging pressurized medium can be arranged in the corresponding end part with a flow direction oriented into the cylinder chamber such that the valve has no parts projecting into the cylinder chamber. The check valve preferably has a flat shape with a lip seal on the side facing the cylinder chamber.

Preferably, sealing means are arranged in the receptacle opening so that the damping pin can be sealed in at least one flow direction during insertion into the open receptacle, whereby effective end position damping can be achieved. The end parts may contain channel means that are connected to the devices for feeding and discharging pressurized medium, that open into the cylinder chamber, and that are associated with throttle means which affect the flow of pressurized medium, and which can be adjusted, if necessary. By virtue of such channel means, for the in-stroke of the piston into the corresponding end position after insertion of the damping pin into the matching receptacle opening, the pressurized medium acting as the piston can be throttled so that the piston can completely reach its end position.

A guiding device for the piston can be provided that has at least one rod extending the length of and parallel to the cylinder chamber, with the piston being sealed against this rod and, preferably, with the rod being fixed at the end parts. Alternatively, the guiding device of the piston can be effected by other means, such as by means of a non-circular cross section piston rod and/or piston and guide or guides in the corresponding end part in the tubular body or bodies surrounding the cylinder chamber.

Other objects and advantages of the invention will become apparent upon reading the following detailed description and upon reference to the drawings, in which.

Figure 1:
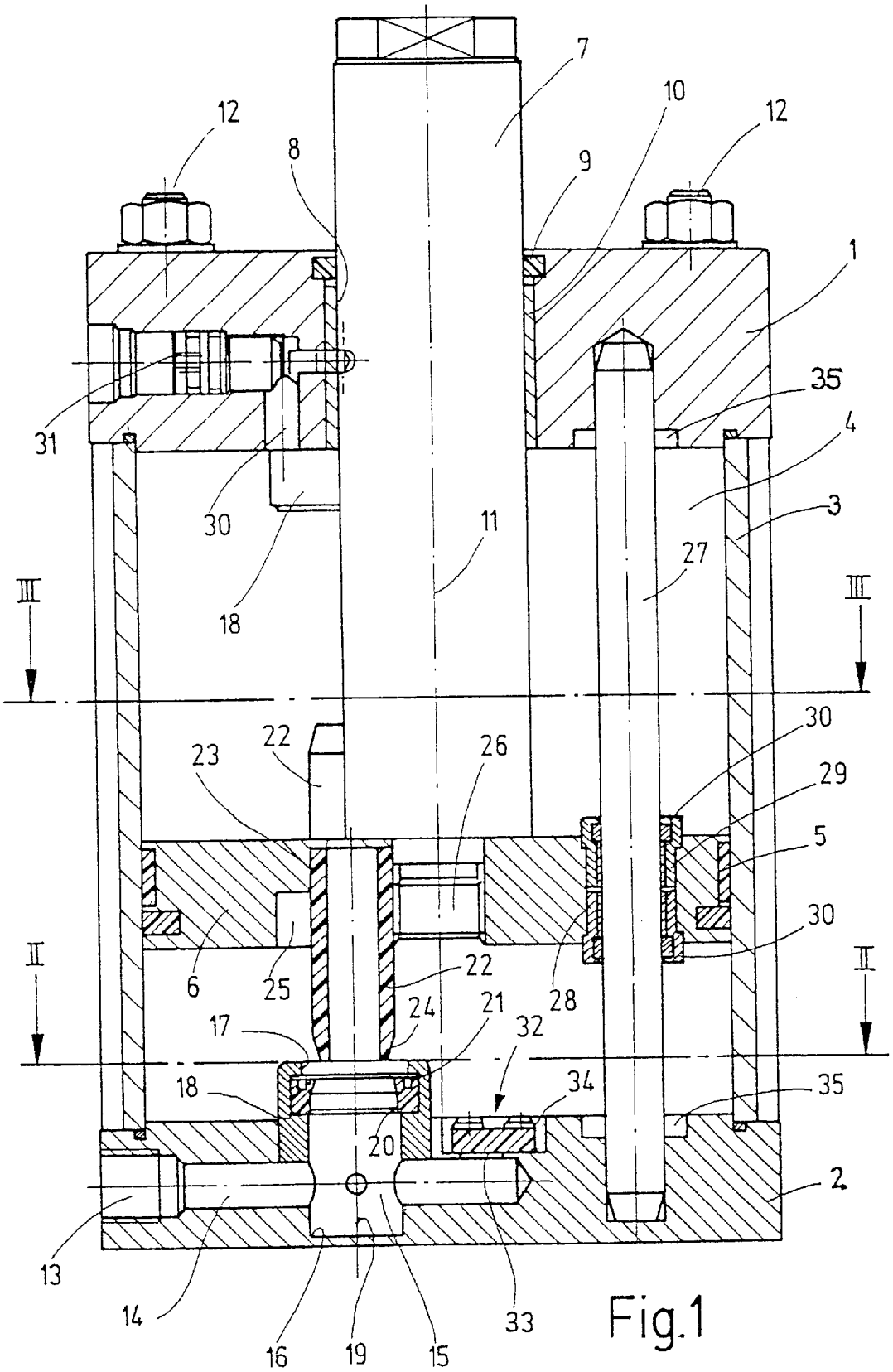
FIG. 1 is a longitudinal section of a pressure cylinder in accordance with the invention showing an in-stroke of the piston rod in the cylinder chamber shortly before reaching an end position.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DESCRIPTION OF THE PREFERRED EMBODIMENT

Referring now more particularly to the drawings, there is shown an illustrated pressure or working cylinder in accordance with the invention which includes a pair of end parts 1, 2 in the form of rectangular plates that are connected in sealed relation to a cylinder tube 3 extending between the end parts. The end parts 1, 2 and cylinder tube 3 define a cylinder chamber 4, within which a cylindrical piston 6 is supported for relative longitudinal movement. The piston 6 has an edge seal 5 for sliding engagement with the cylinder tube 3 and a coaxial cylinder rod 7 rigidly connected to and extending from one side thereof. The cylinder rod 7 is supported for relative movement in an opening 8 of the end part 1 and sealed with respect to the end part 1 by a seal 9. A support sleeve 10 in this case supports the cylinder rod for relative movement. The two end parts 1, 2 are braced against each other and the interposed tube 3 by adjustable bolts 12 spaced evenly about the piston 6.

Each of the end parts 1, 2 is formed with a pressure medium feeding and discharging channel 14 having a threaded connection 13 for connection to an appropriate pressurized medium supply line. Only the channel for the end part 2 is shown in detail, but it will be understood that the channel for the end part 1 is similar. The channel 14 in this case communicates with a cylindrical recess or bore 15 parallel to the axis 11 of the pressure cylinder. The recess 15 is closed at one end 16 and opens on the other side into a cylindrical receptacle opening 17 in the cylinder chamber 4. The receptacle opening 17 is defined by a cylindrical tubular housing 18 disposed coaxial to the axis 19 of the recess 15 and is supported in sealed relation in a hole in the end part 1, 2. The housing 18 projects axially from the end part 1, 2 into the cylinder chamber 4 so that the opening 17 is axially spaced with respect to an end face of the end part 1, 2. A cylindrical sealing ring 20 is provided in the housing 18, and this ring is held in a corresponding annular groove 21 of the housing 18.

Cylindrical damping sleeves 22, which may be made of plastic, are mounted on the pistons 6 in axial alignment with each receptacle opening 17. Each sleeve 22 projects beyond an end side of the piston facing the adjacent end part 1, 2 and is inserted in sealed relation into a corresponding receptacle hole 23 of the piston so that the sleeve is closed at the end supported by the piston. Alternatively, instead of the damping sleeve 22, a solid, preferably cylindrical pin could be used. The damping sleeve or pin preferably has a conical chamfer at the end facing the receptacle opening 17.

Figure 2:
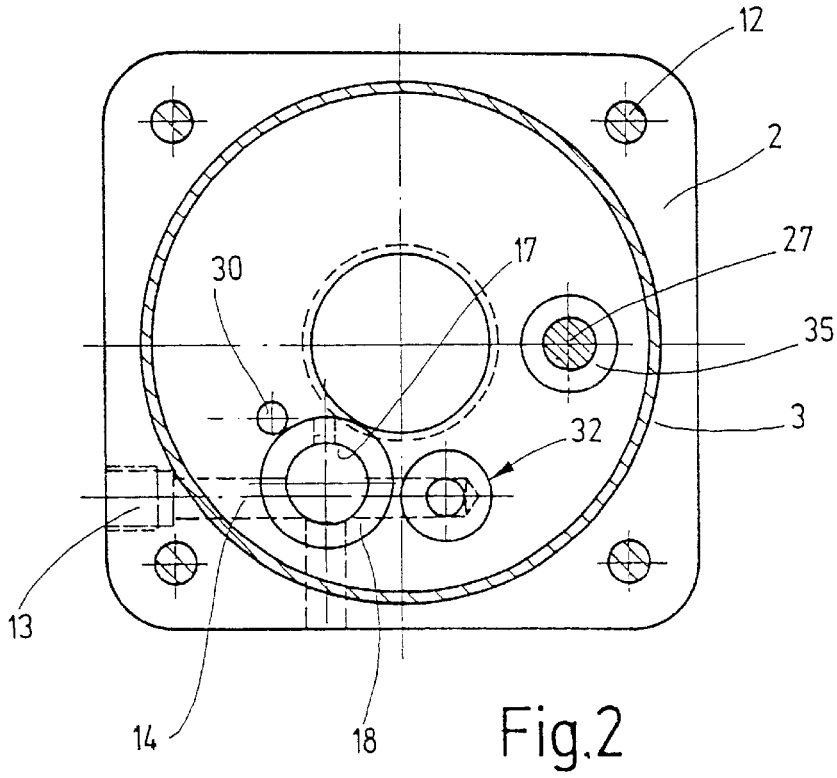
FIG. 2 is a transverse section taken in the plane of line II—II in FIG. 1.
Figure 3:
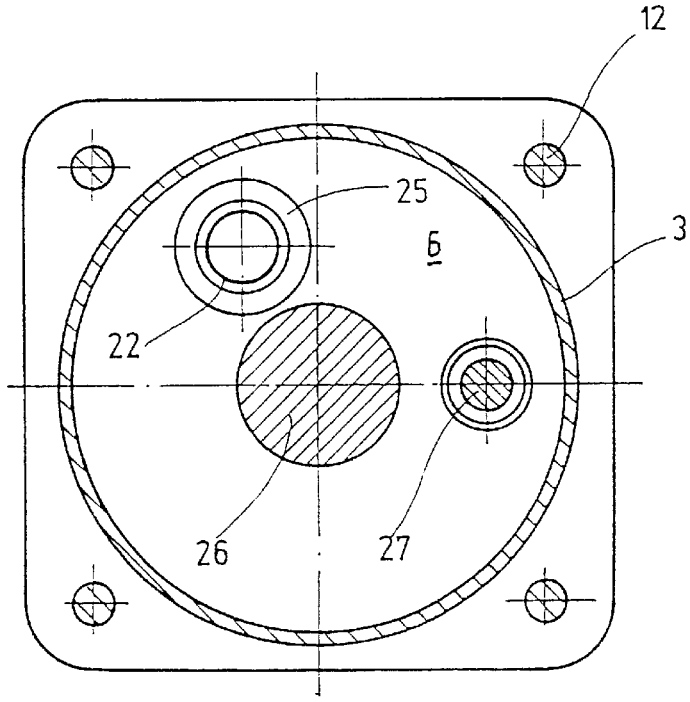
FIG. 3 is a transverse section of the pressure cylinder shown in FIG. 1, taken in the plane of line III—III in FIG. 1.
Figure 4:
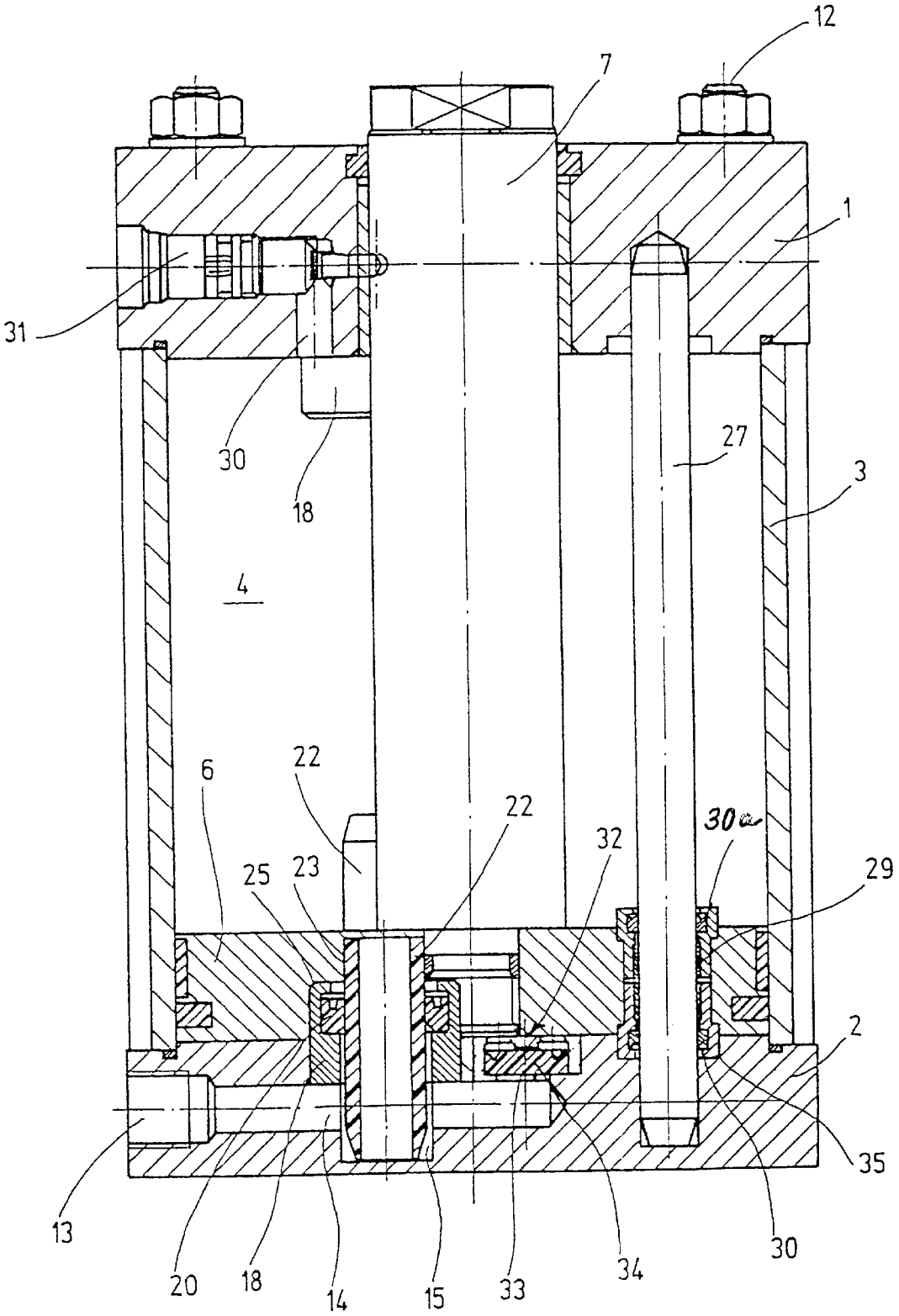
FIG. 4 is a longitudinal section of the illustrated pressure cylinder, similar to FIG. 1, but showing the piston when it has completely reached the end position.

Coaxial to the damping sleeve 22 there is a cylindrical recess 25 in the piston 6, whose diameter is somewhat larger than that of the housing 18 and that is dimensioned so that when the piston 6 contacts at each end part 1 or 2, the corresponding housing 18 is completely received in the recess 25, as depicted in FIG. 2.

In keeping with an important aspect of the invention, the damping sleeve 22 and receptacle opening 17 are disposed in the housing with their axis 19 eccentric to the axis 11 of the piston rod 7 and the piston 6. Hence, the damping sleeve 22 and annular recess 25 are located a lateral distance from the piston rod axis 11. A coaxial attachment pin 26 in this instance connects the damping sleeve 22 to the piston 6. The dimensioning of the piston rod 7 and its attachment to the piston 6 are not affected by the damping sleeve 22 and the housing 18.

In order to ensure that the damping sleeve 22 reliably enters the receptacle opening 17 when the piston 6 approaches at each end part 1 or 2, the piston 6 has a guide device which includes a cylindrical rod 27 parallel to the piston rod 7 which extends the length of the cylinder and has opposite ends fixed in the end parts 1,2. The rod 27, which extends the axial length of the cylinder, is arranged to the side of the piston rod 11 and extends through a through hole 28 in the piston 6. The through hole 28 in this case has a support housing 29 with a pair of seal rings 30*a* that seal the piston 6 with respect to the rod 27.

It will be appreciated that the rod 27 is only one form of guide device for preventing relative rotation of the piston and for ensuring movement of the sleeve 22 into the receptacle 17. Alternatively, other forms of guide devices could be used, such as, for example, forming the piston rod 7 and/or the piston 6 with a non-circular cross-sectional configuration, somewhat like the well known so-called K profile. Piston rods 7 and/or the piston 6 with such non-circular cross-sectional shape then would match corresponding non-circular guidance surfaces on the support sleeve 8 and/or on the cylinder tube 3.

In n carrying out the invention, in each of the two end pieces 1, 2 there is a pressurized medium discharge flow channel 30 parallel to the receptacle opening 17, that connects the pressurized medium feeding and discharging channel 14 to the cylinder chamber 4, and that contains a throttle element 31 that can be adjusted from the outside and that enables the passage cross section of the discharge channel 30 to be reduced, i.e., to be throttled.

Finally, in each of the two end parts 1, 2 there is a check valve 32 in a flow channel 33 between the pressurized medium feeding and discharging channel 14 and the cylinder chamber 4 and whose flow direction is oriented towards the piston chamber 4. The check valve 32, as can be seen particularly from FIGS. 1, 2, has a flat shape. It comprises a flat, disk-shaped sealing element 34 with external lip seals and no parts projecting past the surface of the end parts 1 or 2 facing the cylinder chamber 4.

The pressure activated working cylinder described above acts as follows:

For example, for the in-stroke of the piston rod 7 into the working cylinder, the section of the cylinder chamber 4 in FIG. 1 above the piston 6 is charged with pressurized medium by means of the pressurized medium feeding and discharging channel 14 in the end part 1. The pressurized medium feeding and discharging line 14 that leads into the section of the cylinder chamber 4 under the piston 6 is evacuated. The pressurized medium first flows away, particularly through the receptacle opening 17 and the pressurized medium feeding and discharging channel 14. With the approach of the damping sleeve 22 into the receptacle opening 17, the annular gap formed between the receptacle opening 17 and the damping sleeve 22 is increasingly reduced, so that the outward flow of the pressurized medium from the section of the cylinder chamber 4 under the piston 6 is also increasingly throttled until the damping sleeve 22 enters the sealing ring 20 and thus completely closes the receptacle opening 17. Pressurized medium can then only flow out through the discharge channel 30, whose passage cross section is reduced according to purpose by the throttle element 31. The throttled flow of the escaping pressurized medium adjusted in this way determines the speed with which the piston 6 reaches its end position according to FIG. 2, in which the piston 7 contacts the end part 2.

FIG. 2 shows that in the piston end position, the housing 18 containing the receptacle opening 17 is received completely in the recess 25 of the piston 6, while the support housing 29 containing the two sealing rings 30*a* is inserted into a corresponding recess 35 of the end part 2. The damping sleeve 22 is completely received in the housing 18 and in the recess 15. It can be seen that the damping device consisting of the elements 14–22 has no additional installation requirement in the axial direction of the piston rod, with the consequence that the working cylinder has a relatively short axial length.

If the piston 6 is now moved away from its end position according to FIG. 2, then the pressurized medium feeding and discharging channel 14 of the end part 2 is supplied with pressurized medium. Thus, the sealing ring 20 formed as a lip seal is charged with pressurized medium against the sealing direction and around the damping sleeve 22. In addition, pressurized medium enters through the pressurized medium discharge channel 30 that is throttled in cross section into the section of the cylinder chamber 4 bordered by the bottom side of the piston 6. In order to achieve sufficient acceleration for the piston 6, the check valve 32 is now activated and opened by the accelerating pressurized medium. Thus, pressurized medium flows through the channel 33 against only a small flow resistance into the cylinder chamber 4, while the pressurized medium feeding and discharging channel 14 is evacuated in the opposing end part 1. The piston 6 moves from its end position upwards until the damping sleeve 22 is completely moved away from the receptacle opening 17, and thus the pressurized medium can flow unimpaired through the receptacle opening 17 that has a relatively large inside diameter.

What is claimed is:

1. A pressurized medium activated working cylinder comprising an elongated cylinder body (3) having end parts (1, 2) at opposite ends thereof, said cylinder body (3) and end parts (1,2) defining a cylinder chamber (4), a piston (6) supported for axial movement in said cylinder chamber (4) between end positions adjacent each end part (1, 2), said piston (6) including a rigid body portion with a sealing member in interposed relation between a perimeter of the rigid body portion and a wall of the cylinder chamber for providing sliding sealing contact therebetween, said piston (6) having a piston rod (7) fixed thereto and extending in sealed relation through at least one of the end parts (1) for relative movement, a feed device (13, 14) associated with each end of the cylinder for feeding and discharging pressurized medium into the chamber on a respective side of said piston (6), a damping device (22, 17) associated with each end of The cylinder for damping movement of the piston when it approaches a respective end position, each damping device including a damping pin (22) and a receptacle (18) having an opening (17) that matches the pin on a side of the piston (6) facing the respective end part, said damping pin (22) being insertable into the receptacle opening (17) when the piston approaches an end position, said damping pin (22) and the receptacle opening (17) being disposed in eccentric relation to the side of the piston rod (7), said receptacle having at least a part projecting from one of the rigid piston body or respective end part (1,2) into the cylindrical cylinder (4), and the other of said rigid piston body portion and respective end part (1, 2) being formed with a recess in a side thereof facing the chamber in an eccentric inwardly spaced relation to the cylinder chamber wall and sealing member for receiving the receptacle projecting part as an incident to movement of the piston to an end position.

2. The working cylinder of claim 1 in which said receptacle (18) of each damping device is mounted in a respective end part (1, 2).

3. The working cylinder of claim 2 in which at least one of said end parts (1, 2) has a check valve (32) connected to the device (13, 14) for feeding and discharging pressurized medium to the cylinder chamber (4), said end parts (1, 2) each having a channel (30) connected between the device (13, 14) for feeding and discharging pressurized medium and the pressure chamber (4), and a throttling device (31) in said channel (30) for controlling the flow of pressurized medium.

4. The working cylinder of claim 3 including a guiding device having at least one guide rod (27) extending the length of said cylinder chamber (4) in parallel relation to said piston rod, and said guide rod (27) extending in sealed relation through said piston (6).

5. The working cylinder of claim 3 in which the damping pin (22) is in the form of a sleeve.

6. The working cylinder of claim 1 including a guiding device within the cylinder chamber for guiding movement of the piston and preventing relative rotation thereof.

7. The working cylinder of claim 6 in which said device includes at least one guide rod (27) extending The length of said cylinder chamber (4) in parallel relation to said piston rod, and said guide rod extending in sealed relation through said piston (6).

8. The working cylinder of claim 6 in which said guiding device is defined by a non-circular cross section the piston rod and operating guide surface.

9. The working cylinder of claim 6 in which said guiding device is defined by a non-circular cross section of the piston and cooperating guide surfaces.

10. The working cylinder of claim 6 in which the damping pin (22) is in the form of a sleeve.

11. The working cylinder of claim 1 in which said receptacle is mounted on said end plate, and said receptacle opening (17) is connected in fluid communication with the corresponding device (13, 14) for feeding and discharging pressurized medium into the cylinder chamber (4) on the respective side of the piston (6).

12. The working cylinder of claim 11 in which at least one of said end parts (1, 2) has a check valve (32) connected to the device (13, 14) for feeding and discharging pressurized medium to the cylinder chamber (4), said check valve (32) having a flow direction oriented into the cylinder chamber (4) and being mounted in the end part (1, 2) without parts projecting into the cylinder chamber (4).

13. The working cylinder according to claim 11 in which said end parts (1, 2) each have a channel (30) connected between the device (13, 14) for feeding and discharging pressurized medium and the pressure chamber (4), and a throttling device (31) in said channel (30) for controlling the flow of pressurized medium.

14. The working cylinder according to claim 11 including a seal (20) in the receptacle opening (17) for sealing the inserted damping pin (22) in at least one flow direction.

15. The working cylinder of claim 11 in which the damping pin (22) is mounted in sealed relation in a hole (23) in said piston (6).

* * * * *